US007659801B2

(12) United States Patent
Kusumoto et al.

(10) Patent No.: US 7,659,801 B2
(45) Date of Patent: Feb. 9, 2010

(54) STARTER

(75) Inventors: Keiichi Kusumoto, Tokyo (JP); Hayato Yamauchi, Tokyo (JP); Motoaki Kimura, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/452,295

(22) Filed: Jun. 14, 2006

(65) Prior Publication Data

US 2007/0139146 A1 Jun. 21, 2007

(30) Foreign Application Priority Data

Dec. 7, 2005 (JP) ..... P2005-353235

(51) Int. Cl.
*H01H 67/02* (2006.01)

(52) U.S. Cl. ..... 335/126; 335/131; 335/132

(58) Field of Classification Search ..... 335/126, 335/131, 132
See application file for complete search history.

(56) References Cited

U.S. PATENT DOCUMENTS 2,510,789 A * 6/1950 Wright ..... 290/37 R
4,994,683 A * 2/1991 Yamamoto ..... 290/31
5,432,384 A * 7/1995 Isozumi et al. ..... 290/48
5,563,563 A * 10/1996 Freitas et al. ..... 335/126
5,642,696 A * 7/1997 Matsui ..... 123/179.1
5,854,583 A * 12/1998 Falchetti ..... 337/290
6,028,381 A * 2/2000 Yumiyama et al. ..... 310/68 C
6,201,311 B1 * 3/2001 Kamei et al. ..... 290/38 R
6,239,678 B1 * 5/2001 Yamauchi ..... 335/126
6,520,137 B2 * 2/2003 Ooizumi et al. ..... 123/179.3
6,787,962 B2 * 9/2004 Yagi et al. ..... 310/245
6,863,041 B2 * 3/2005 Nagai et al. ..... 123/179.25
6,923,152 B2 * 8/2005 Nagai et al. ..... 123/179.25
6,937,123 B2 * 8/2005 Imanishi et al. ..... 335/126
7,034,643 B1 * 4/2006 Kusumoto et al. ..... 335/126

(Continued)

FOREIGN PATENT DOCUMENTS

JP 9-273464 10/1997

(Continued)

OTHER PUBLICATIONS

Japanese Office Action dated Dec. 25, 2007.

*Primary Examiner*—Elvin G Enad
*Assistant Examiner*—Mohamad A Musleh
(74) *Attorney, Agent, or Firm*—Sughrue Mion, PLLC

(57) ABSTRACT

A starter includes a starter motor, a main circuit section, a main switch section including a main contact section to cut a current, a main plunger driven to open and close the main contact section, suction and holding coils, battery and motor terminals, and a switch terminal connected to the battery through a start switch, and opening and closing the main contact section in accordance with movement of the main plunger, a suction circuit section connected in parallel with the main circuit section and connected in series with the suction coil, a holding circuit section connected in series with the holding coil, and a breaking section connected in series with the suction coil inside the suction circuit section. The breaking section cuts electricity conduction when electricity is continuously conducted to the suction coil to bring about layer short circuit and a short circuit current flows at the suction circuit section.

4 Claims, 9 Drawing Sheets

U.S. PATENT DOCUMENTS

| | | | | |
|---|---|---|---|---|
| 7,038,564 | B1 * | 5/2006 | Kusumoto et al. | 335/126 |
| 7,067,934 | B2 * | 6/2006 | Kitagawa et al. | 290/38 R |
| 7,088,208 | B2 * | 8/2006 | Kurasawa et al. | 335/255 |
| 7,116,196 | B1 * | 10/2006 | Hirabayashi | 335/282 |
| 2003/0189472 | A1 * | 10/2003 | Shiga et al. | 335/126 |
| 2004/0012902 | A1 * | 1/2004 | Ikeda | 361/23 |
| 2004/0207204 | A1 * | 10/2004 | Shiga et al. | 290/38 R |
| 2005/0051126 | A1 * | 3/2005 | Oomi et al. | 123/179.25 |
| 2005/0141164 | A1 * | 6/2005 | Bender et al. | 361/104 |
| 2005/0212647 | A1 * | 9/2005 | Goldsberry et al. | 337/198 |
| 2006/0055497 | A1 * | 3/2006 | Harris et al. | 337/14 |

FOREIGN PATENT DOCUMENTS

| | | |
|---|---|---|
| JP | 9-273466 | 10/1997 |
| JP | 2004-52572 A | 2/2004 |
| JP | 2005-54706 | 3/2005 |
| JP | 2005-54706 A | 3/2005 |
| JP | 2005-110484 | 4/2005 |

* cited by examiner

STARTER

BACKGROUND OF THE INVENTION

1. Field of the Invention

The present invention relates to a starter used in starting an engine of, for example, an automobile or the like.

2. Description of the Related Art

A starter of a background art is constructed by a constitution including a fuse in series with a suction coil constituting a starter. (Refer to, for example, JP-A-2005-54706, page 10, FIG. 2)

Further, also in a starter of a background art having an auxiliary switching function is constructed by a constitution including a fuse in series with a suction coil constituting the starter. (Refer to, for example, JP-A-2004-52572, page 8, FIG. 1)

A general starter is constructed by a constitution in which by closing a start switch provided for starting the starter, a pinion gear provided to the starter and a ring gear provided to an engine are brought in mesh with each other, and a rotating operation of the starter is transmitted to the engine and therefore, in a case in which teeth of both of the pinion gear and the ring gear collide with each other and are not brought in mesh with each other normally, and in a case in which the start switch for starting the engine is continuously closed and the suction coil is conducted with electricity for a long period of time or a case in which an operation of opening the start switch once and thereafter immediately closing the start switch is continuously carried out repeatedly and the suction coil is intermittently conducted with electricity for a long period of time, there is a concern that a temperature of the suction coil rises, an insulating coating of the suction coil is melted to bring about layer short circuit, and a short circuit current flows.

Therefore, according to the starter of the background art, there is used a fuse a melting temperature of which is set to be low to be connected in series with the suction coil such that electricity conduction to the suction coil is cut before bringing the suction coil into layer short circuit, however, the fuse is comparatively easily melted to cut by conducting normal current and therefore, by cutting the fuse, the starter is not operated, and the state in which the engine cannot be started is brought about frequently.

Further, according to the starter of the background art, a resistance value of the fuse varies widely from high and low owing to production tolerance or the like, as a result, a current having a value different from a normal value flows in the fuse, a temperature rise of the fuse is changed and also a time period of cutting the fuse becomes a different value. Hence, when the fuse is melted to cut by a time period shorter than normal, that is, there is further frequently brought about the state in which the engine cannot be started, and it is difficult to design a fuse melted to cut by a predetermined time period for avoiding the state.

SUMMARY OF THE INVENTION

The invention has been carried out in order to resolve the above-described problem and it is an object thereof to provide a starter restraining a state in which an engine cannot be started from being brought about and facilitating to design the fuse.

According to an aspect of the present invention, a starter includes a starter motor that is supplied with a current from a battery and generates a rotational force, a main circuit section that makes the current flow from the battery to the starter motor, a main switch section including a main contact section that is provided at the main circuit section and cuts the current in the main circuit section, a main plunger that is driven to open and close the main contact section, a suction coil that generates a magnetic force to suck the main plunger, a holding coil that generates a magnetic force to hold the sucked main plunger, a battery terminal connected to the battery and constituting one fixed contact of the main contact section, a motor terminal connected to the starter motor and constituting other fixed contact of the main contact section, and a switch terminal that is connected to the battery through a start switch and conducts electricity to the suction coil and the holding coil, the main switch section opening and closing the main contact section in accordance with movement of the main plunger, a suction circuit section connected in parallel with the main circuit section and connected in series with the suction coil between the start switch and the motor terminal, a holding circuit section connected in series with the holding coil between the switch terminal and other end of the battery, and a breaking section that is connected in series with the suction coil inside the suction circuit section and cuts electricity conduction to the suction coil. The breaking section cuts electricity conduction when electricity is continuously conducted to the suction coil to bring about layer short circuit and a short circuit current flows at the suction circuit section.

According to the invention, the breaking section is not cut before the suction coil is brought into layer short circuit and the breaking section is cut after the suction coil is brought into layer short circuit and the short circuit current flows at the breaking section. Further, even when a current value conducted to the suction coil becomes a different value owing to a tolerance in fabricating the breaking section or the like and also a time period of bringing the suction coil into layer short circuit differs from normal, in order to bring the suction coil into layer short circuit, a time period sufficiently longer than a time period of breaking a fuse applied to the starter of the background art is needed to restrain a state in which the breaking section is cut and an engine cannot be started from being brought about.

Further, when the short circuit current flows at the breaking section, a temperature of the breaking section rapidly rises to reach a melting temperature in a short period of time and therefore, a change in a temperature rise produced owing to a tolerance of fabricating the breaking section or the like is restrained, and also an error in a time period required until the suction coil is brought into layer short circuit and the breaking section is melted to cut is reduced. Therefore, design of the breaking section is facilitated.

DETAILED DESCRIPTION OF THE INVENTION

Embodiment 1

Figure 1:
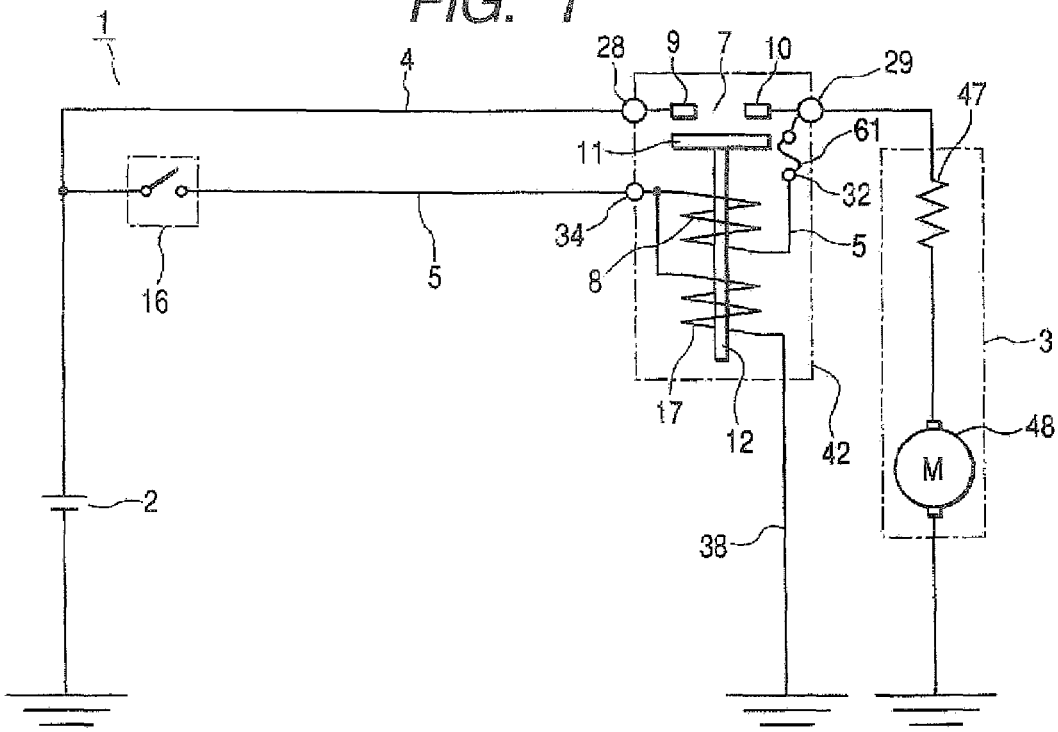
FIG. 1 is an electric wiring diagram of a starter according to Embodiment 1 of the invention.
Figure 2:
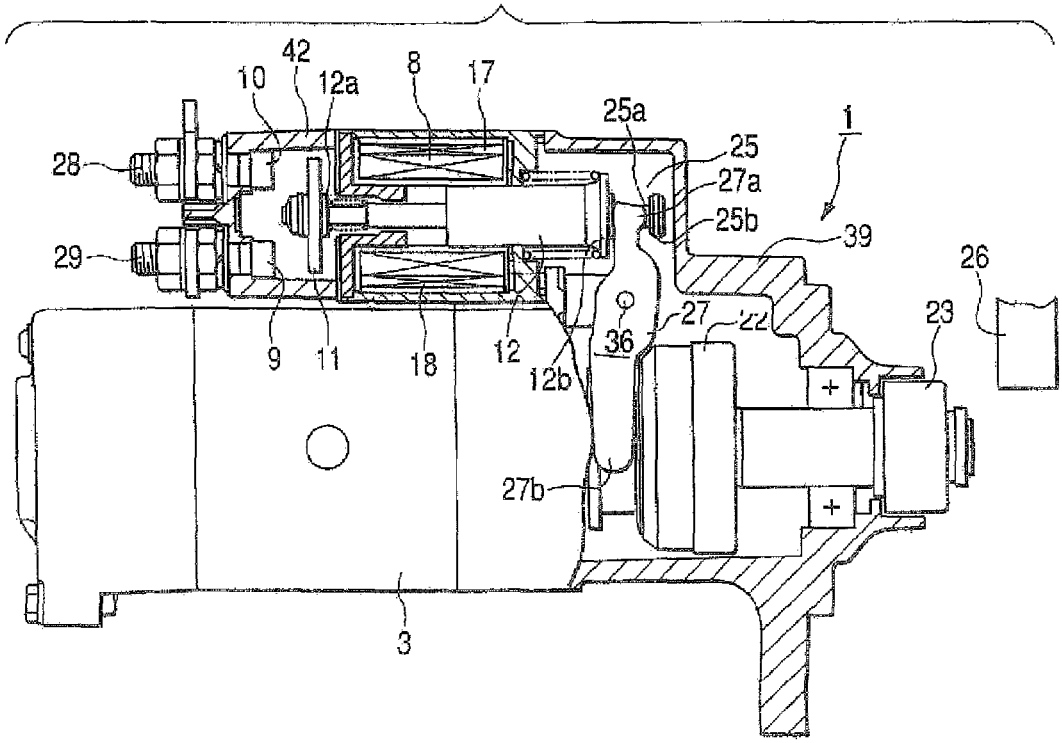
FIG. 2 is a half sectional view of a side face of the starter shown in FIG. 1.
Figure 3:
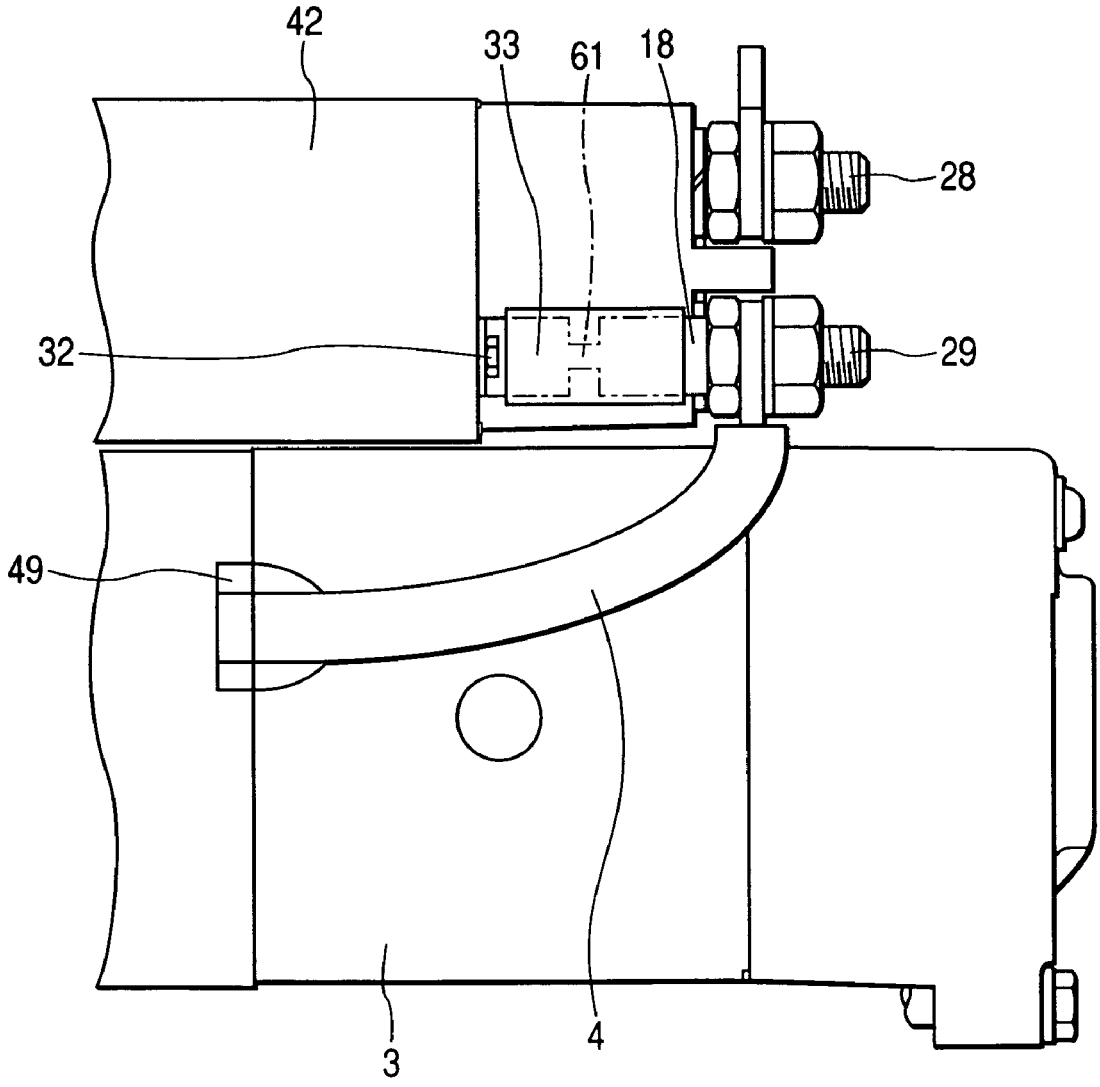
FIG. 3 is a half side view of the starter according to Embodiment 1 of the invention.
Figure 4A:
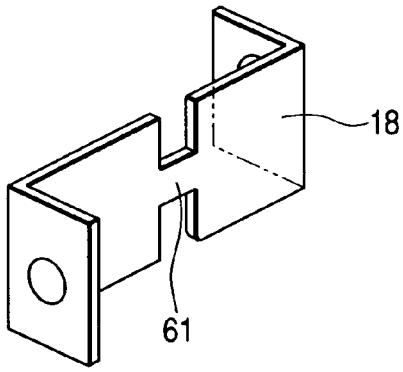
FIGS. 4A to 4C illustrate constitution view s of a breaking section provided at the starter shown in FIG. 1.
Figure 4B:
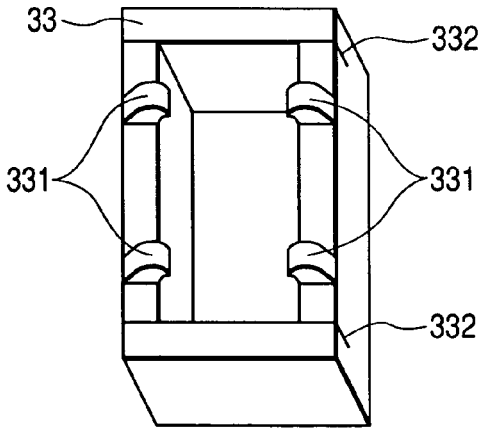
Figure 4C:
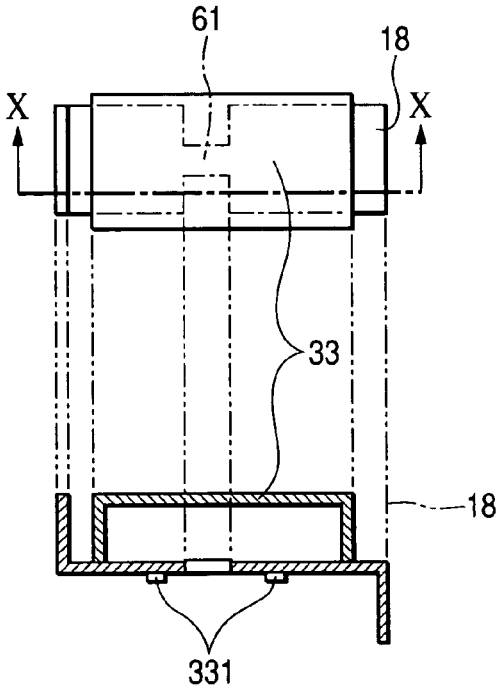
Figure 5A:
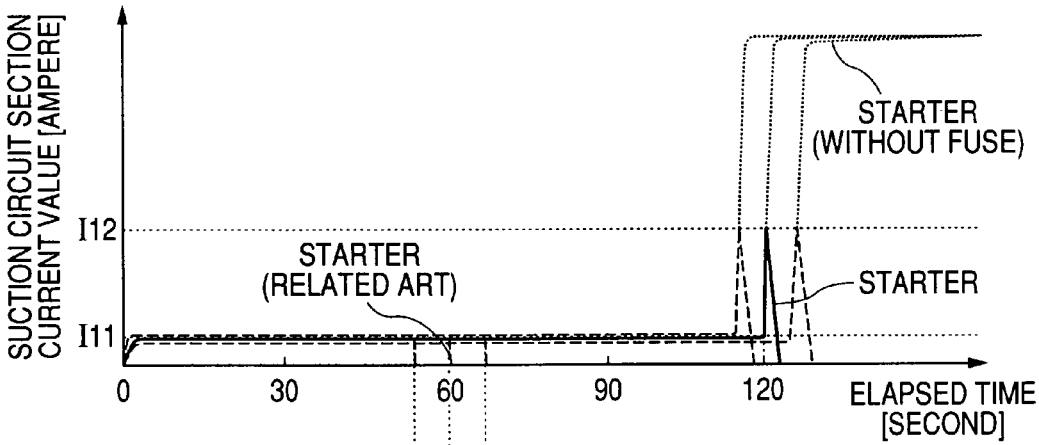
FIGS. 5A and 5B are characteristic diagrams of the breaking section applied to the starter according to Embodiment 1 of the invention.
Figure 5B:
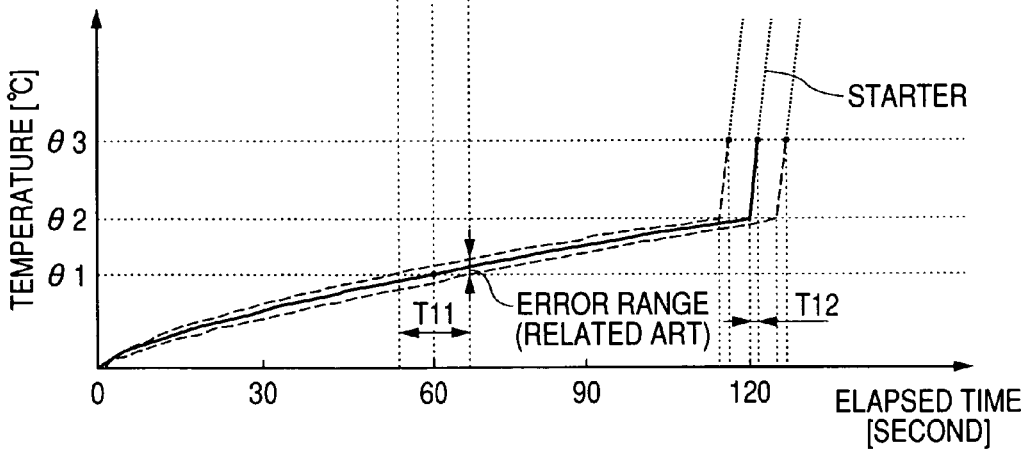

FIG. 1 is an electric wiring diagram of a starter according to Embodiment 1 of the invention. FIG. 2 is a half sectional view of a side face of the starter shown in FIG. 1. FIG. 3 is a half side view of the starter shown in FIG. 1. FIGS. 4A to 4C are constitution views of a breaking section provided at the starter shown in FIG. 1. FIGS. 5A and 5B are diagrams showing a characteristic of the breaking section according to Embodiment 1.

First, a structure of the starter according to Embodiment 1 of the invention will be described.

In FIG. 1, a starter motor 3 provided at a starter 1 is electrically connected to a battery 2 by way of a main circuit section 4. The main circuit section 4 includes a main contact section 7 connected with a field coil 47 for opening and closing electric connection from the battery 2 to the starter motor 3.

A suction circuit section 5 includes a suction coil 8 for generating a magnetic flux for opening and closing the main contact section 7. Further, the suction circuit section 5 is connected in parallel with the main circuit section 4 and a start switch 16 and the suction coil 8 and a breaking section 61 are provided on the suction circuit section 5.

A holding circuit section 38 includes a holding coil 17 one end of which is connected to a switch terminal 34 constituting a connection point between the start switch 16 and the suction coil 8 and other end of which is connected to a minus side terminal of the battery 2.

The main contact section 7 includes a battery side fixed contact 9 constituted at a battery terminal 28, a starter motor side fixed contact 10 constituted at a motor terminal 29 and a movable contact 11 provided movably to contact and separate the battery side fixed contact 9 and the starter motor side fixed contact 10 constituted at the motor terminal 29. The movable contact 11 is attached to a main plunger 12 in a rod-like shape driven by conducting electricity to the suction coil 8 and the holding coil 17. A main switch section 42 operated as an electromagnetic switch is constituted from the main contact section 7, the suction coil 8, the holding coil 17 and the main plunger 12.

Successively, as shown by FIG. 2, the starter motor 3 is attached to a housing 39 along with the main switch section 42. An output shaft of the starter motor 3 is connected with a pinion gear 23 brought in mesh with a ring gear 26 connected to an engine by way of an overrunning clutch 22. Further, the main switch section 42 is provided contiguously to the starter motor 3 such that an axis line of the main plunger 12 is in parallel with an axis line of the starter motor 3. According to the main plunger 12, one end portion 12*a* thereof is attached with the movable contact 11 and other end portion 12*b* thereof is formed with a locking section 25 having a small diameter section 25*a* and a circular plate section 25*b*.

Further, the main plunger 12 and the output shaft of the starter motor 3 are connected by a lever 27. The lever 27 is pivotably provided at a pin member 36 arranged between the axis line of the main plunger 12 and the axis line of the starter motor 3. Further, according to the lever 27, one end portion 27*a* thereof is arranged at the small diameter section 25*a* of the locking section 25 and other end portion 27*b* thereof is arranged between the starter motor 3 and the overrunning clutch 22.

Here, as shown by FIG. 3 a metal plate 18 is provided for connecting a connecting terminal 32 at one end of the suction coil 8 and the motor terminal 29. The metal plate 18 serves also as a breaking section 61 melted to cut by making a short circuit current flow. The breaking section 61 is melted to cut when the suction coil 8 is brought into layer short circuit by melting an insulating coating of the suction coil 8 and the short circuit current flows at the suction circuit section 5. Further, according to the breaking section 61, a width of a portion of the metal plate is formed to be narrower than that of other portion. Further, the width and a material (example: copper or brass) are determined in accordance with a current value of melting to cut the breaking section 61. Further, as shown by FIGS. 4A to 4C, a cover 33 made of a resin is fixed to the metal plate 18 so as to cover the breaking section 61 by utilizing a claw portion 331 formed at the cover 33 for fixing the metal plate 18 and a cut portion 332 provided to facilitate to fix to the metal plate 18. Further, the suction circuit section 5 is connected to the starter motor 3 by way of a grommet 49 after connected to the main circuit section 4 by the motor terminal 29.

Operation of the starter according to Embodiment 1 will be explained as follows.

According to the starter 1, by closing the start switch 16, electricity is conducted from the battery 2 to the suction circuit section 5 and the holding circuit section 38, thereby, a magnetic flux is generated by the suction coil 8 and the holding coil 17 provided to the main switch section 42. By the magnetic flux, the main plunger 12 and the movable contact 11 are driven to the main contact section 7.

When the main contact section 7 is closed by the movable contact 11, that is, when the movable contact 11 is brought into contact with the battery side fixed contact 9 and the starter motor side fixed contact 10, electricity is started to be conducted from the battery 2 to the field coil 47 and an armature coil 48 provided to the starter motor 3 by way of the main contact section 7 and the main circuit section 4. Further, the pinion gear 23 is brought in mesh with the ring gear 26 by pushing the overrunning clutch 22 and the pinion gear 23 to an outer side in an axial direction of the starter motor 3 by driving the lever 27 connected to the main plunger 12 by constituting a fulcrum by the pin member 36 in accordance with driving the main plunger 12.

Further, when the main contact section 7 is closed, potentials at the both ends of the suction coil 8 become equal and therefore, electricity conduction to the suction coil 8 is stopped. However, electricity conduction to the holding coil 17 is continued to maintain a state of closing the main contact section 7 by a magnetic flux produced by the holding coil 17.

Successively, when the start switch 16 is opened, the magnetic flux is nullified by stopping to conduct electricity to the suction coil 8 and the holding coil 17 and therefore, the main contact section 7 is opened by pushing back the movable contact 11 and the main plunger 12 by a spring, not illustrated. Simultaneously with nullifying electricity conducted to the starter motor 3, the lever 27 is driven to finish the state of bringing the ring gear 26 and the pinion gear 23 in mesh with each other.

In this way, by conducting electricity to the starter motor 3 by way of the main circuit section 4, the starter motor 3 is started to rotate and a rotational force thereof is transmitted to the engine, not illustrated, by way of the ring gear 26 and the pinion gear 23.

When by some cause, for example, teeth of the ring gear 26 and the pinion gear 23 collide with each other and the state of closing the switch 16 continues, the main contact section 7 is not closed.

When the state continues, temperatures of the suction circuit section 5 and the holding circuit section 38 rise, the insulating coating of the suction coil 8 is melted to be brought into layer short circuit and a short circuit current flows at the suction circuit section 5. When the short circuit current flows, the breaking section 61 provided at the metal plate 18 connected to the suction circuit section 5 is melted to cut.

When the breaking section 61 is melted to cut in this way, spark is generated at the melted to cut portion. In order to restrain the spark from being scattered, as shown by FIG. 3, the cover 33 is provided at a surrounding of the breaking section 61. As shown by FIG. 4B, the cover 33 is provided with the claw portion 331 and the cut portion 332. Four of the claw portions are provided and the claw portions are squeezed to inner sides from both sides of the metal plate 18 to be fixedly attached thereto. As shown by FIG. 4C, the cover 33 is fixed to the metal plate 18 by using the claw portions. A lower portion of FIG. 4C shows a sectional view cut by a line X-X. Thereby, the spark can be avoided from being scattered to other constituent element provided at a vicinity of the metal plate 18.

FIGS. 5A and 5B illustrate diagrams for comparing characteristics of the breaking section 61 used in the starter according to the invention and the fuse used in JP-A-2005-54706. In FIG. 5A, the abscissa designates an elapsed time and the ordinate designates a value of a current conducted to the suction circuit section 5. In FIG. 5B, the abscissa designates the elapsed time and the ordinate designates a change in a temperature of the breaking section 61.

As shown by FIGS. 5A and 5B, the fuse of JP-A-2005-54706 is cut when a current I11 equal to or smaller than 90% of a starting current to the suction coil 8 (example: 45 amperes) continuously for 60 seconds. In contrast thereto, according to the starter of the invention, when the current I11 is conducted continuously for, for example, 120 seconds, the insulating coating of the suction coil 8 is melted to bring about layer short circuit and a short circuit current I12 flows, the breaking section 61 is immediately melted to cut electricity conduction.

Successively, as shown by FIG. 5B, according the fuse of JP-A-2005-54706, when the current I11 (example: 45 amperes) is conducted continuously for 60 seconds, since a temperature of the fuse is set to be low to be melted to cut at θ1 degrees (example: 300 degrees) and therefore, the fuse is comparatively easily melted to cut. Further, in the case of the elapsed time (60 seconds) of cutting the fuse of JP-A-2005-54706, an inclination of the graph shown in FIG. 5B is small, in addition thereto, a conducted current value of the fuse becomes a different value owing to a tolerance in fabricating the fuse or the like, and there is brought about an error of T11 seconds (example: 10 seconds) in a time period by which the temperature of the fuse reaches θ1 degrees. Therefore, there is a concern of frequently bringing about a state in which the fuse is melted to cut by a short period of time and the engine cannot be started and it is difficult to design the fuse which is melted to cut by a predetermined time period in order to avoid the state.

In contrast thereto, according to the breaking section 61 used in the invention, when the temperature of the suction coil 8 reaches a temperature θ2 for melting the film to bring about layer short circuit and the short circuit current I12 flows, the temperature of the breaking section 61 is set to be higher than that of JP-A-2005-54706 to be melted to cut at θ3 degrees (example: 1000 degrees) and a frequency of melting to cut the breaking section 61 can be restrained. Further, in the case of the elapsed time of cutting the breaking section 61 (120 seconds), the inclination of the graph shown in FIG. 5B becomes larger than that at 60 seconds, even when the value of the current conducted to the breaking section 61 becomes a different value owing to the error of fabricating the fuse or the like, since the inclination of the graph is large, the error becomes T12 (example: 1 through 2 seconds) and can be made to be smaller than the error time T11. Further, even when the time period of bringing the suction coil into layer short circuit owing to a different current value of electricity conduction differs from normal, for bringing the suction coil into layer short circuit, a time period sufficiently longer than the time period of melting the fuse applied to the starter of the background art is needed to restrain the state in which the engine cannot be started by cutting the breaking section from being brought about.

Further, although according to Embodiment 1, there is described the constitution of providing the breaking section 61 between the connection terminal 32 at the one end of the suction coil 8 and the motor terminal 28, a similar effect can be achieved even in a case in which the breaking section 61 is provided at an arbitrary location of the suction circuit section 5.

Further, by providing the portion of deforming the metal plate 18 as the breaking section 61, there can be provided a starter capable of providing the breaking section without increasing a number of constituent elements of the starter of the background art.

Further, although an explanation has been given of the starter provided with the field coil 47 according to Embodiment 1, a similar effect can be achieved even in a case of applying the invention to a starter when a permanent magnet is provided in place of the field coil 47.

Embodiment 2

According to the embodiment, a case of applying the invention to a starter provided with an auxiliary switch at the suction circuit section to be described as an example of the starter according to the invention.

Figure 6:
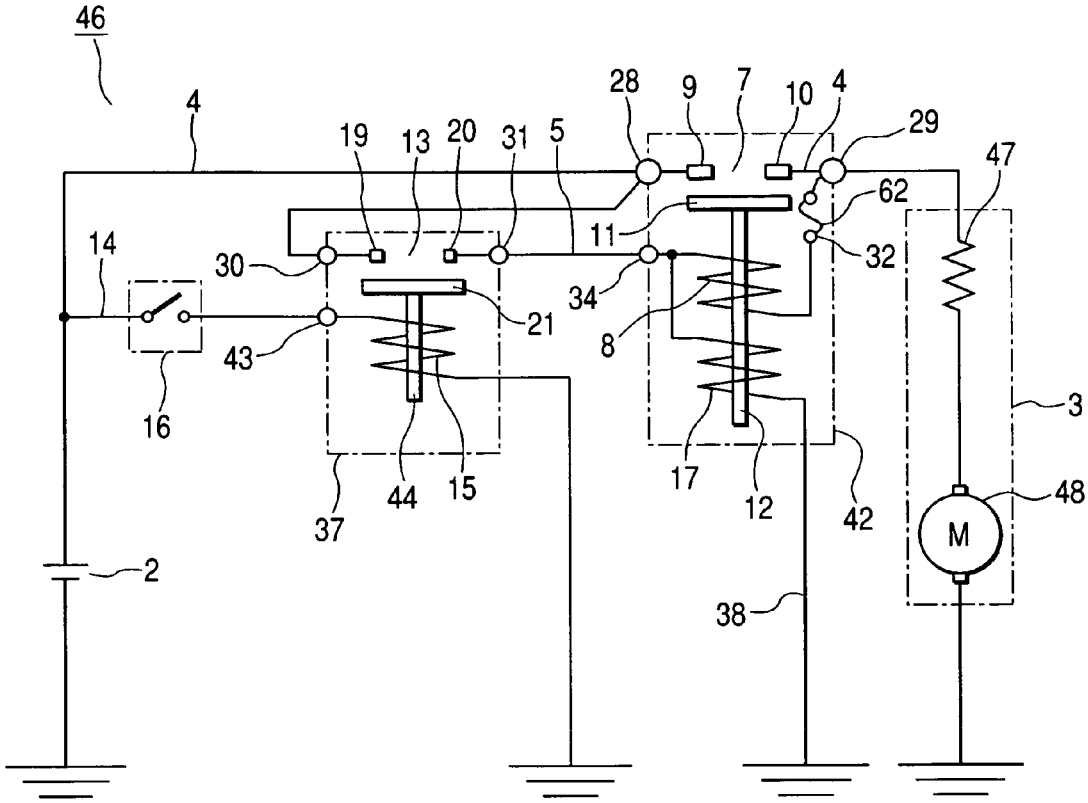
FIG. 6 is an electric wiring diagram of a starter according to Embodiment 2 of the invention.
Figure 7:
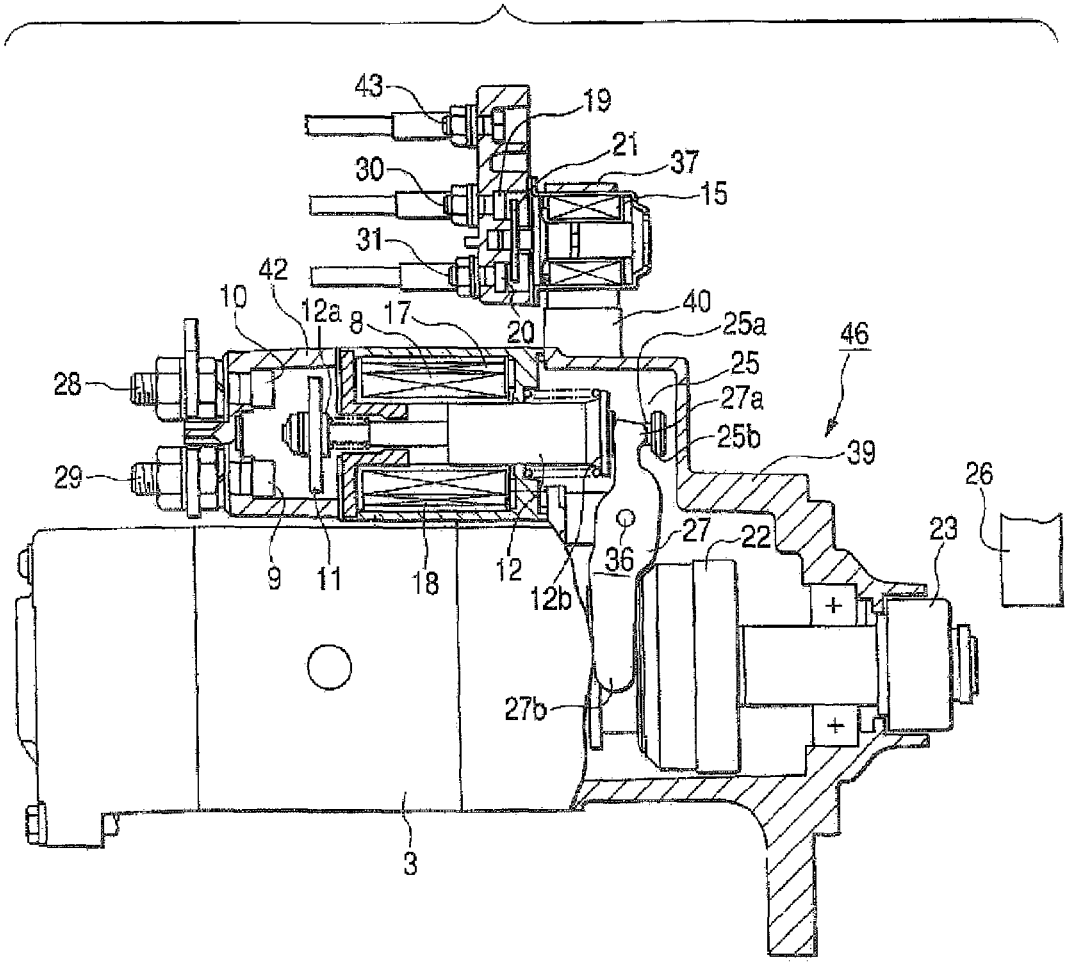
FIG. 7 is a half sectional view of a side face of the starter shown in FIGS. 4A to 4C.
Figure 8:
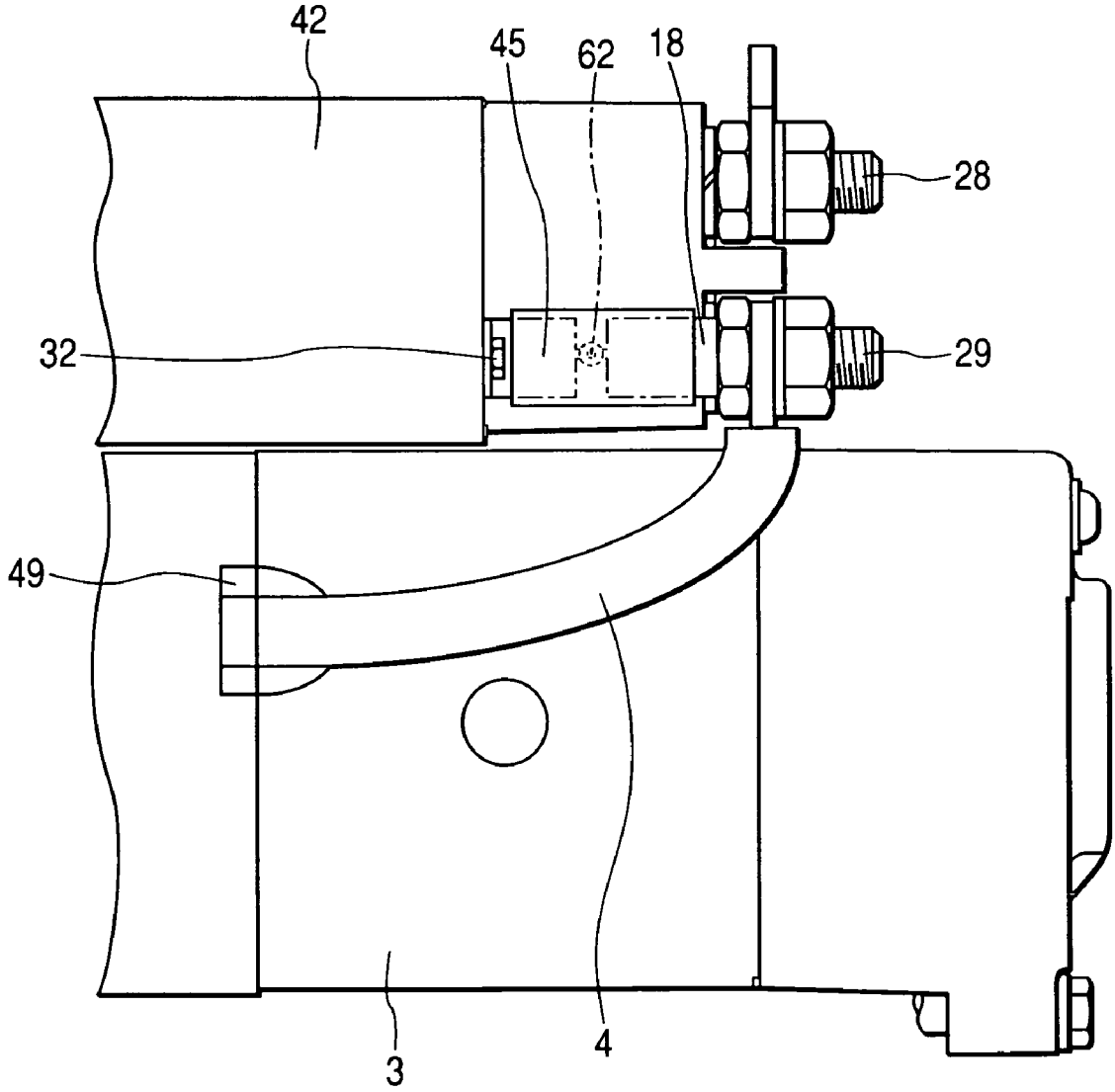
FIG. 8 is a half side view of the starter according to Embodiment 2 of the invention.
Figure 9A:
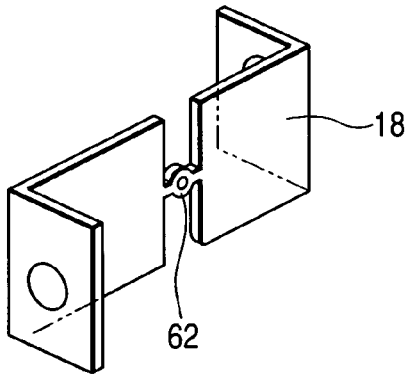
FIG. 9A to 9C illustrates constitution views of a breaking section provided at the starter according to Embodiment 2 of the invention.
Figure 9B:
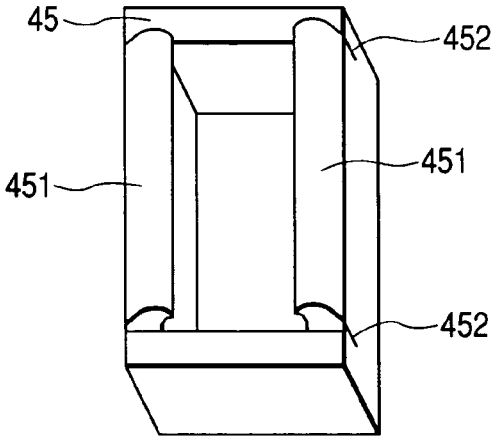
Figure 9C:
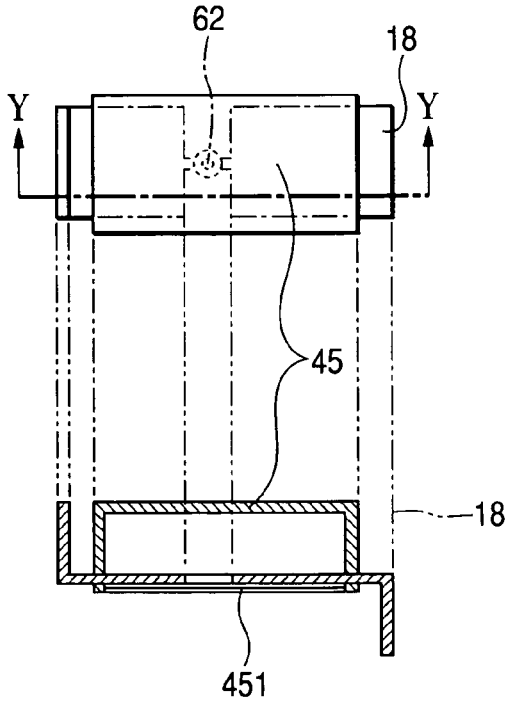
Figure 10A:
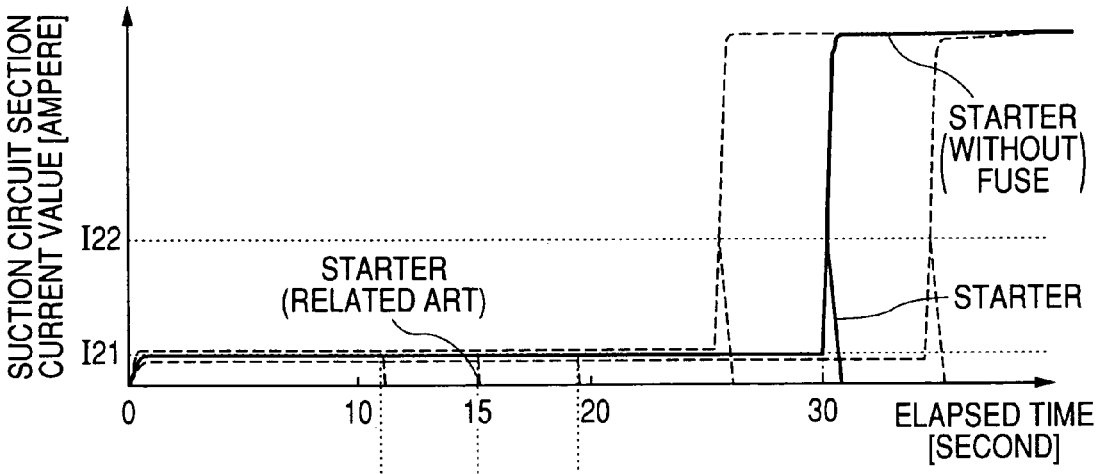
FIGS. 10A and 10B are a characteristic diagram of the breaking section applied to the starter according to Embodiment 2 of the invention.
Figure 10B:
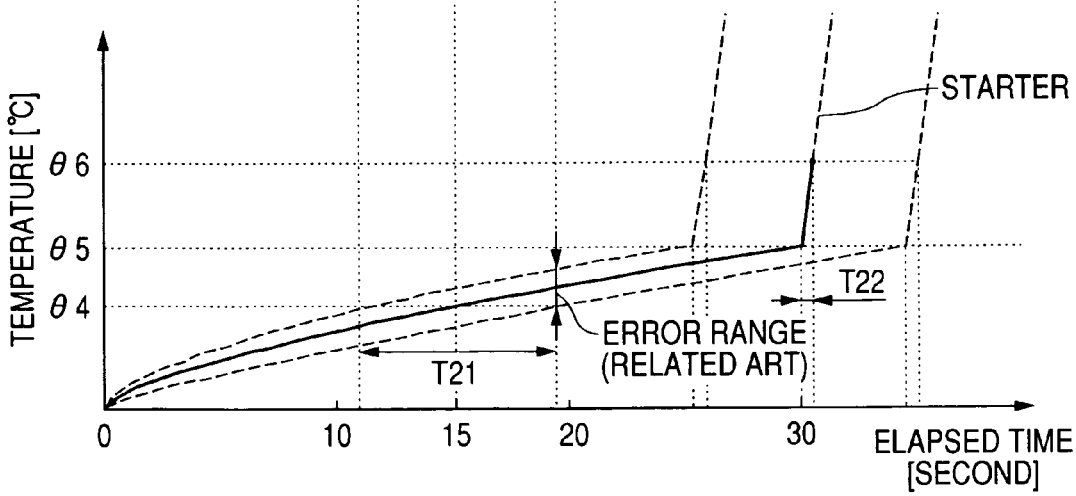

FIG. 6 is an electric wiring diagram of a starter according to Embodiment 2 of the invention. FIG. 7 is a half section view of a side face of the starter shown in FIG. 6. FIG. 8 is a half side view of the starter shown in FIG. 6. FIG. 9A to 9C are constitution views of a breaking section provided at the starter shown in FIG. 6. FIGS. 10A and 10B are diagrams showing a characteristic of the breaking section according to Embodiment 2.

Successively, a structure of the starter according to Embodiment 2 of the invention will be described. In the following drawings, portions the same as those of Embodiment 1 are attached with the same notations and an explanation thereof will be omitted.

In FIG. 6, an auxiliary contact section 13 provided to a starter 46 is provided on the suction circuit section 5 and between the battery terminal 28 and the switch terminal 34 and includes a first fixed contact 19 constituted at an auxiliary battery terminal 30, a second fixed contact 20 constituted at an auxiliary switch output terminal 31, and an auxiliary movable contact 21 provided movably for contacting and separating the first fixed contact 19 and the second fixed contact 20. The auxiliary movable contact 21 is attached to an auxiliary plunger 44 in a rod-like shape driven by conducting electricity to the suction coil 15. An auxiliary switch section 37 operated as an electromagnetic switch is constituted from the auxiliary contact section 13, the auxiliary suction coil 15 and the auxiliary plunger 44.

A start circuit section 14 includes an auxiliary suction coil 15 connected to both ends of the battery 2 for generating a magnetic flux for opening and closing the auxiliary contact section 13. Further, the start switch 16 is provided on the start circuit section 14 for switching electricity conduction to the auxiliary suction coil 15.

Here, as shown by FIG. 7, the auxiliary switch section 37 according to the embodiment is attached to the housing 39 byway of an attaching member 40. Further, the auxiliary switch section 37 can naturally be attached to an arbitrary location other than being attached to the housing 39.

Successively, as shown by FIG. 8, the metal plate 18 serves also as a breaking section 62 melted to cut by a temperature rise by conducting electricity. The breaking section 62 is provided with a hole portion and the hole portion and a surrounding of the hole portion are covered by a metal having a melting temperature lower than that of the material (example: copper or brass) of the metal plate 18 although not illustrated. By providing the hole portion, the metal having the low melting temperature can easily be fixed to the breaking section 62.

Operation of the starter according to Embodiment 2 will be explained as follows.

According to the starter 46, by closing the start switch 16, electricity is conducted from the battery 2 to the start circuit section 14, thereby, a magnetic flux is generated by the auxiliary suction coil 15 provided to the auxiliary switch section 37. Thereby, the auxiliary plunger 44 and the auxiliary movable contact 21 are driven.

When the auxiliary contact section 13 is closed by the auxiliary movable contact 21, that is, when the movable contact 21 is brought into contact with the first fixed contact 19 the second fixed contact 20, electricity is started to conduct from the battery 2 to the suction coil 8 by way of the suction circuit section 5, and electricity is started to conduct to the holding coil 17 by way of the holding circuit section 38. When the main contact section 7 is closed by driving the main plunger 12 and the movable contact 11 to the main contact section 7 by the magnetic flux, electricity is started to be conducted from the battery 2 to the starter motor 3 by way of the main contact section 7 and the main circuit section 4.

Further, the current conducted to the suction coil 8 is sufficient for rotating the starter motor 3 and even when the pinion gear 23 and the ring gear 26 collide with each other, by conducting electricity to the field coil 47 and the armature coil 48 provided to the starter motor 3 by way of the suction circuit section 5, the pinion gear 23 can be rotated to be brought in mesh with the ring gear 26 normally.

Successively, when the start switch 16 is opened, electricity conduction to the auxiliary suction coil 15 is stopped and the magnetic flux is nullified and therefore, the auxiliary contact section 13 is opened by pushing back the auxiliary movable contact 21 and the auxiliary plunger 44 by a spring, not illustrated. Thereby, also electricity conduction to the suction coil 8 and the holding coil 17 is stopped and therefore, the main contact section 7 is opened and electricity is not conducted to the starter motor 3. Simultaneously therewith, the lever 27 is driven to finish the state of bringing the ring gear 26 and the pinion gear 23 in mesh with each other.

By conducting electricity to the starter motor 3 by way of the main circuit section 4 in this way, the starter motor 3 is started to rotate and the rotational force is transmitted to the engine, not illustrated, by way of the ring gear 26 and the pinion gear 23.

When by some cause, for example, teeth of the ring gear 26 and the pinion gear 23 collide with each other and a state of closing the switch 16 is continued, the main contact section 7 is not closed.

When the state continues, temperatures of the suction circuit section 5 and the holding circuit section 38 rise, the insulating coating of the suction coil 8 is melted to bring about layer short circuit and the short circuit current flows at the suction circuit section 5. After making the short circuit current flow, the breaking section 62 provided at the metal plate 18 connected to the suction circuit section 5 is melted to cut.

When the breaking section 62 is melted to cut in this way, spark is generated at the melted to cut portion. In order to restrain the spark from being scattered, as shown by FIG. 8, a cover 45 is provided at a surrounding of the breaking section 62. As shown by FIG. 9B, the cover 45 is provided with a claw portion 451 and a cut portion 452. Two of the claw portions 451 are provided and formed to be provided with a width of the connecting terminal 32 and the motor terminal 29 of the suction coil connected with the metal plate 18. As shown by FIG. 9C, the cover is fixed to the metal plate 18 by using the claw portion 451. A sectional view cut by a linear line Y-Y is shown at a lower portion of FIG. 9C. Thereby, the spark is restrained from being scattered to be able to avoid the spark from being scattered to other constituent element provided at a vicinity of the metal plate 18.

FIGS. 10A and 10B show diagrams for comparing characteristics of the breaking section 62 used in the starter according to the invention and the fuse used in JP-A-2004-52572. In FIG. 10A, the abscissa designates an elapsed time and the ordinate designates a value of a current conducted to the breaking section 62. In FIG. 10B, the ordinate designates a temperature change of the breaking section 62 and the abscissa designates the elapsed time of electricity conduction.

As shown by FIG. 10A, the fuse of JP-A-2004-52572 is cut when a current I21 (example: 300 amperes) to the suction coil 8 is conducted continuously for 15 seconds. In contrast thereto, according to the starter of the invention, when electricity is conducted continuously for, for example, 30 seconds, the insulating coating of the suction coil 8 is melted to bring about layer short circuit and the short circuit current I22 flows, the breaking section 62 is immediately melted to cut electricity conduction.

Successively, as shown by FIG. 10B, according the fuse of JP-A-2004-52572, when the current I21 (example: 300 amperes) is conducted continuously for 15 seconds, since the temperature of the fuse is set to be low to be melted to cut at θ4 degrees (example: 800 degrees) and therefore, the fuse of JP-A-2004-52572 is comparatively easily be melted to cut. Further, in a case of an elapsed time (15 seconds) of cutting the fuse of JP-A-2004-52572, an inclination of a graph shown in FIG. 10B is small, in addition thereto, a conducting current value of the fuse becomes a different value owing to a tolerance in fabricating the fuse or the like to bring about an error of T21 seconds (example: 10 seconds) in a time period by which the temperature of the fuse reaches θ4 degrees. Therefore, there is a concern that the fuse is melted to cut by a short period of time to frequently bring about a state in which the engine cannot be started and it is difficult to design the fuse melted to cut by a predetermined time period in order to avoid the state.

In contrast thereto, according to the breaking section 62 used in the invention, when the temperature of the suction coil 8 reaches the melting temperature θ5 of the film and a short circuit current I22 flows, by bringing about layer short circuit, the temperature of the breaking section 62 is set to be higher than that of JP-A-2004-52572 to be melted to cut at θ6 degrees (example: 1000 degrees) and a frequency of melting to cut the breaking section 62 can be restrained. Further, in a case of an elapsed time (30 seconds) for breaking the breaking section 62, an inclination of a graph shown in FIG. 10B becomes larger than that of the elapsed time of 15 seconds and even when a current value conducted to the breaking section 62 differs owing to a tolerance in fabricating the fuse or the like, since the inclination of the graph is large, the error becomes T22 (example: 1 through 2 seconds) and can be made to be smaller than the error time period T21. Further, even when a time period by which the suction coil is brought into layer short circuit owing to the different conducting current value differs from normal, in order to bring the suction coil into layer short circuit, a time period sufficiently longer than the time period of melting the fuse applied to the starter of the background art is needed to restrain the state in which the breaking section is cut and the engine cannot be started from being brought about.

Thereby, also in the starter 46 provided with the auxiliary switch 37, an effect similar to that of Embodiment 1 can be achieved.

What is claimed is:

1. A starter comprising:

a starter motor that is supplied with a current from a battery and generates a rotational force;

a main circuit section that makes the current flow from the battery to the starter motor;

a main switch section including:

a main contact section that is provided at the main circuit section and cuts the current in the main circuit section;

a main plunger that is driven to open and close the main contact section;

a suction coil that generates a magnetic force to suck the main plunger;

a holding coil that generates a magnetic force to hold the sucked main plunger;

a battery terminal connected to the battery and constituting one fixed contact of the main contact section;

a motor terminal connected to the starter motor and constituting other fixed contact of the main contact section; and a switch terminal that is connected to the battery through a start switch and conducts electricity to the suction coil and the holding coil, the main switch section opening and closing the main contact section in accordance with movement of the main plunger;

a suction circuit section connected in parallel with the main circuit section and connected in series with the suction coil between the start switch and the motor terminal;

a holding circuit section connected in series with the holding coil between the switch terminal and other end of the battery; and a breaking section that is connected in series with the suction coil inside the suction circuit section and cuts electricity conduction to the suction coil, wherein the breaking section cuts electricity conduction when electricity is continuously conducted to the suction coil to bring about layer short circuit and a short circuit current flows at the suction circuit section, wherein the suction coil and the motor terminal are connected by a metal plate, and the breaking section forms a portion of the metal plate, wherein the metal plate is formed by copper or brass, wherein the entire breaking section is narrower in width than remaining portions of the metal plate, wherein the breaking section is covered by a cover on an outer side thereof, and wherein the cover is fixed to the metal plate by at least one prong provided at the cover and wherein the breaking section is provided with a hole portion, and the hole portion is covered with a metal having a melting temperature lower than a melting temperature of a material of the metal plate.

2. The starter according to claim 1, wherein the cover is made of a resin.

3. The starter according to any one of claim 1, wherein the cover covers all of a distance between terminals of the metal plate.

4. A starter comprising:

a starter motor that is supplied with a current from a battery and generates a rotational force;

a main circuit section that makes the current flow from the battery to the starter motor;

a main switch section including:

a main contact section that is provided at the main circuit section and cuts the current in the main circuit section;

a main plunger that is driven to open and close the main contact section;

a suction coil that generates a magnetic force to suck the main plunger;

a holding coil that generates a magnetic force to hold the sucked main plunger;

a battery terminal connected to the battery and constituting one fixed contact of the main contact section;

a motor terminal connected to the starter motor and constituting other fixed contact of the main contact section; and a switch terminal that is connected to the battery through a start switch and conducts electricity to the suction coil and the holding coil, the main switch section opening and closing the main contact section in accordance with movement of the main plunger;

a suction circuit section connected in parallel with the main circuit section and connected in series with the suction coil between the start switch and the motor terminal;

a holding circuit section connected in series with the holding coil between the switch terminal and other end of the battery; and a breaking section that is connected in series with the suction coil inside the suction circuit section and cuts electricity conduction to the suction coil, wherein the breaking section cuts electricity conduction when electricity is continuously conducted to the suction coil to bring about layer short circuit and a short circuit current flows at the suction circuit section, wherein the suction coil and the motor terminal are connected by a metal plate, and the breaking section forms a portion of the metal plate, wherein the metal plate is formed by copper or brass, wherein the entire breaking section is narrower in width than remaining portions of the metal plate, wherein the breaking section is provided with a hole portion, and the hole portion is covered with a metal having a melting temperature lower than a melting temperature of a material of the metal plate.

* * * * *